US012704255B2

(12) United States Patent
Abidin et al.

(10) Patent No.: US 12,704,255 B2
(45) Date of Patent: Aug. 11, 2026

(54) SYSTEMS, APPARATUSES, METHODS, AND COMPUTER PROGRAM PRODUCTS FOR SEGREGATION OF FLARING AND VENTING VOLUMES USING MACHINE LEARNING APPROACHES

(71) Applicant: Honeywell International Inc., Charlotte, NC (US)

(72) Inventors: Shahrul Azman Bin Zainal Abidin, Kuala Lumpur (MY); Madhukar Madhavamurthy Gundappa, Bangalore (IN); Ramesh Murugan Natarajan, Bangalore (IN)

(73) Assignee: Honeywell International Inc., Charlotte, NC (US)

( * ) Notice: Subject to any disclaimer, the term of this patent is extended or adjusted under 35 U.S.C. 154(b) by 696 days.

(21) Appl. No.: 18/118,379

(22) Filed: Mar. 7, 2023

(65) Prior Publication Data

US 2024/0200775 A1 Jun. 20, 2024

(30) Foreign Application Priority Data

Dec. 20, 2022 (IN) ..... 202211073868

(51) Int. Cl.
*F23G 7/08* (2006.01)

(52) U.S. Cl.
CPC ..... *F23G 7/08* (2013.01); *F23G 2207/10* (2013.01); *F23G 2900/55003* (2013.01)

(58) Field of Classification Search
CPC ..... F23G 7/08; F23G 2207/10
USPC ..... 431/5, 202
See application file for complete search history.

(56) References Cited

U.S. PATENT DOCUMENTS 6,278,374 B1 * 8/2001 Ganeshan ..... F23N 5/082 431/79
2008/0233523 A1 * 9/2008 Diepenbroek ..... F23G 5/50 431/14

* cited by examiner

*Primary Examiner* — Vivek K Shirsat
(74) *Attorney, Agent, or Firm* — Alston & Bird LLP

(57) ABSTRACT

Systems, apparatuses, methods, and computer products for segregating flaring and/or venting volumes are provided, including for segregating flaring and/or venting into one or more classifications using machine learning approaches. For example, a method may include receiving sensor data associated with a flare from at least a first sensor, determining a first gas volume of a first gas associated with the flare, and determining, via a machine learning process, one or more classifications of the flare based on the sensor data and the first gas volume. The classifications may be chosen from a set of classifications including routine flaring, non-routine flaring, and safety flaring.

20 Claims, 5 Drawing Sheets

SYSTEMS, APPARATUSES, METHODS, AND COMPUTER PROGRAM PRODUCTS FOR SEGREGATION OF FLARING AND VENTING VOLUMES USING MACHINE LEARNING APPROACHES

TECHNOLOGICAL FIELD

Example embodiments of the present disclosure relate generally to flaring and venting of gases, and more particularly to segregation of flaring and venting volumes using machine learning approaches.

BACKGROUND

Reducing greenhouse gas emissions is a target to be achieved for multiple industries and organizations. Exemplary industries include, among others, oil and gas, refining, chemicals, and power generation. While greenhouse gas emissions in such industries may be from a number of sources, the industries include plants and/or processing units that may flare gasses and/or vent gasses to the atmosphere.

The inventors have identified numerous areas of improvement in the existing technologies and processes, which are the subjects of embodiments described herein. Through applied effort, ingenuity, and innovation, many of these deficiencies, challenges, and problems have been solved by developing solutions that are included in embodiments of the present disclosure, some examples of which are described in detail herein.

BRIEF SUMMARY

Various embodiments described herein relate to systems, apparatuses, and methods for segregation of flaring and venting volumes using machine learning approaches.

In accordance with some embodiments of the present disclosure, an example method is provided. The method may comprise: receiving sensor data from at least a first sensor, wherein the sensor data is associated with a flare; determining, based on the sensor data, a first gas volume of a first gas associated with the flare; and determining, via a machine learning process, one or more classifications of the flare based on the sensor data and the first gas volume, wherein the one or more classifications is chosen from a set of classifications including routine flaring, and wherein at least one of the one or more classifications of the flare is determined to be routine flaring.

In some embodiments, the set of classifications further includes non-routine flaring and safety flaring.

In some embodiments, the first sensor is a camera.

In some embodiments, the camera is configured to capture images in a visible light spectrum and an infrared light spectrum.

In some embodiments, the machine learning process is based on a flare profile of the flare over time.

In some embodiments, the machine learning process is based on a volume change of the flare over time.

In some embodiments, the method further comprises training, prior to the determining one or more classifications of the flare based on the sensor data and the first gas volume, the machine learning process based on historical sensor data associated with one or more classifications of historical flares.

In some embodiments, the flare is associated with a plurality of gases, and the method further comprises determining a second gas volume, wherein the second gas volume is associated with a gas that is distinct from a first gas associated with the first gas volume.

In some embodiments, the method further comprises generating a user alert based on a classification.

In some embodiments, the method further comprises generating, for a user interface, one or more dashboards for display on the user interface, wherein a first dashboard is configured to display a visualization of the first gas volume and at least one classification of the first gas volume.

In accordance with some embodiments of the present disclosure, an example apparatus is provided. The apparatus may comprise, at least one processor and at least one memory coupled to the processor, wherein the processor is configured to: receive sensor data from at least a first sensor, wherein the sensor data is associated with a flare; determine, based on the sensor data, a first gas volume of a first gas associated with the flare; and determine, via a machine learning process, one or more classifications of the flare based on the sensor data and the first gas volume, wherein the one or more classifications is chosen from a set of classifications including routine flaring, and wherein at least one of the one or more classifications of the flare is determined to be routine flaring.

In some embodiments, the set of classifications further includes non-routine flaring and safety flaring.

In some embodiments, the first sensor is a camera.

In some embodiments, the camera is configured to capture images in a visible light spectrum and an infrared light spectrum.

In some embodiments, the machine learning process is based on a flare profile of the flare over time.

In some embodiments, the machine learning process is based on a volume change of the flare over time.

In some embodiments, the processor is further configured to: train, prior to the determining one or more classifications of the flare based on the sensor data and the first gas volume, the machine learning process based on historical sensor data associated with one or more classifications of historical flares.

In some embodiments, the flare is associated with a plurality of gases, and the method further comprises determining a second gas volume, wherein the second gas volume is associated with a gas that is distinct from a first gas associated with the first gas volume.

In some embodiments, the processor is further configured to generate a user alert based on a classification.

In some embodiments, the processor is further configured to generate, for a user interface, one or more dashboards for display on the user interface, wherein a first dashboard is configured to display a visualization of the first gas volume and at least one classification of the first gas volume.

The above summary is provided merely for purposes of summarizing some example embodiments to provide a basic understanding of some aspects of the disclosure. Accordingly, it will be appreciated that the above-described embodiments are merely examples and should not be construed to narrow the scope or spirit of the disclosure in any way. It will also be appreciated that the scope of the disclosure encompasses many potential embodiments in addition to those here summarized, some of which will be further described below.

BRIEF SUMMARY OF THE DRAWINGS

Figure 1:
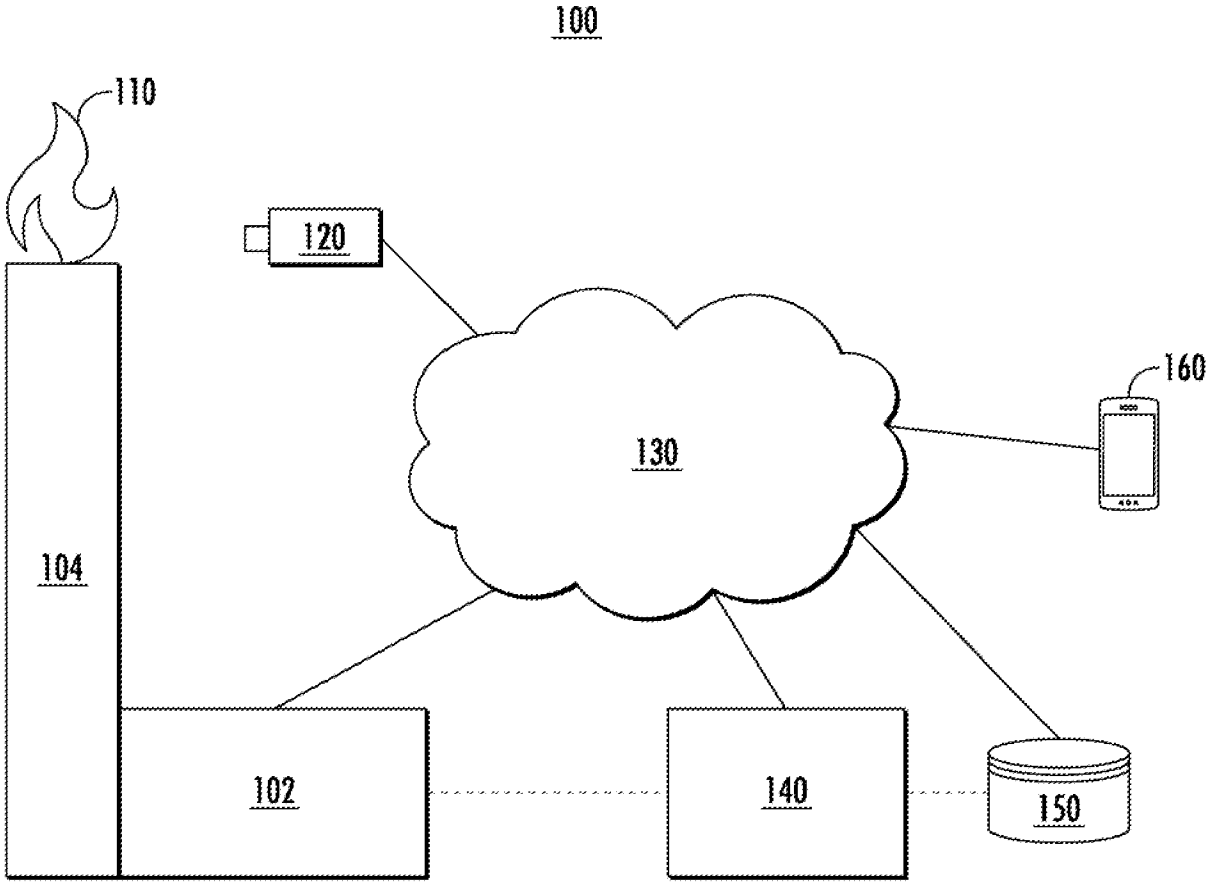
Figure 2:
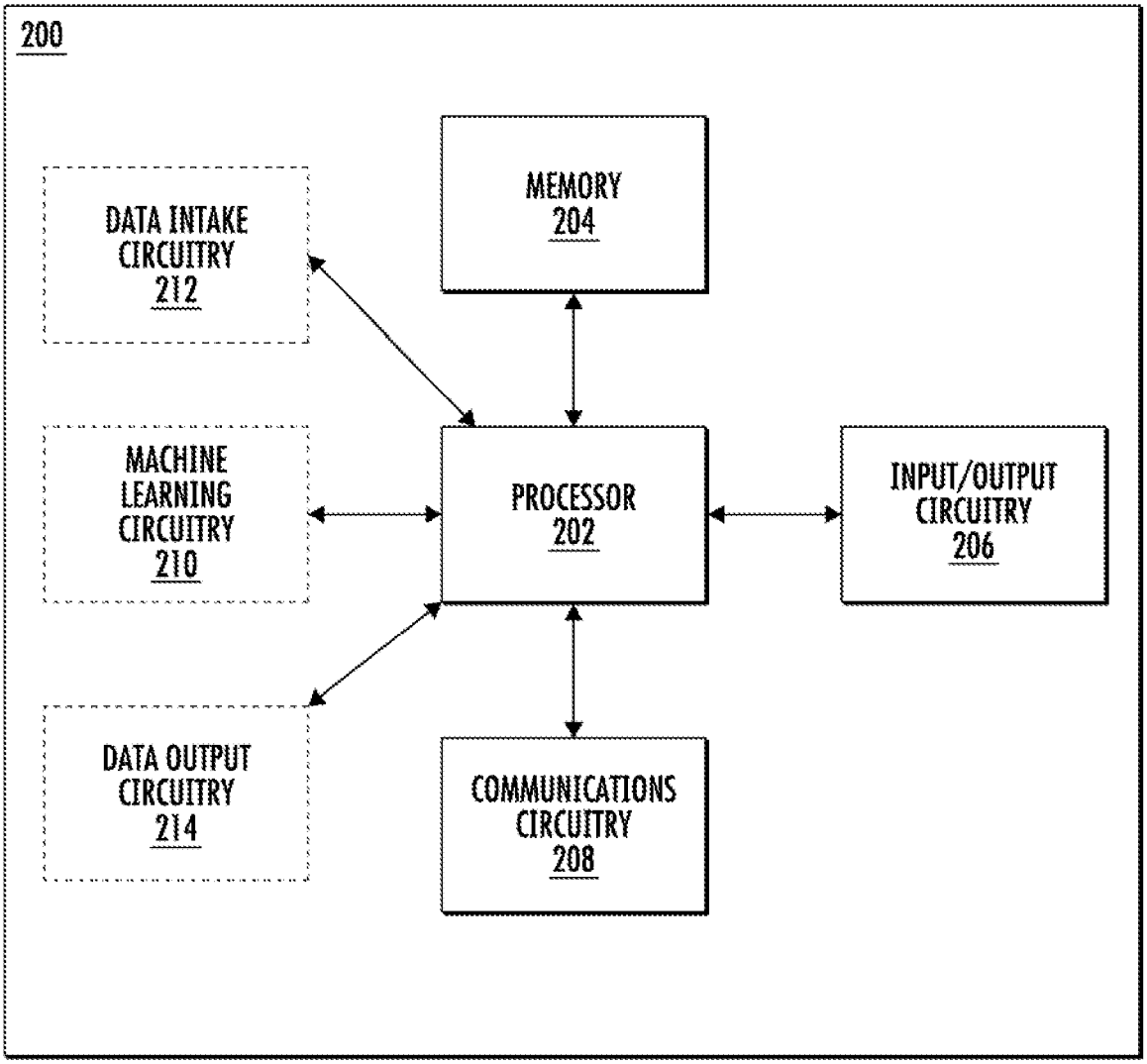
Figure 3:
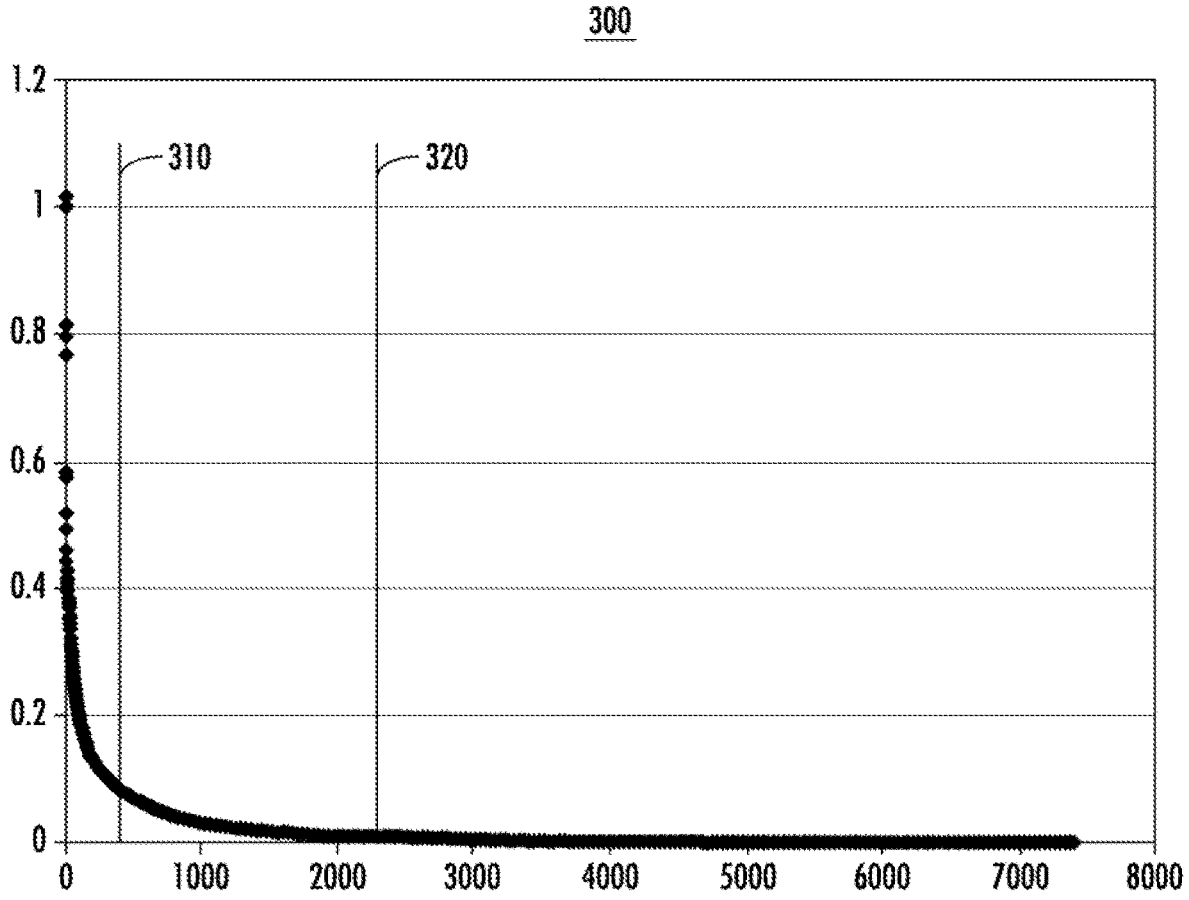
Figure 4:
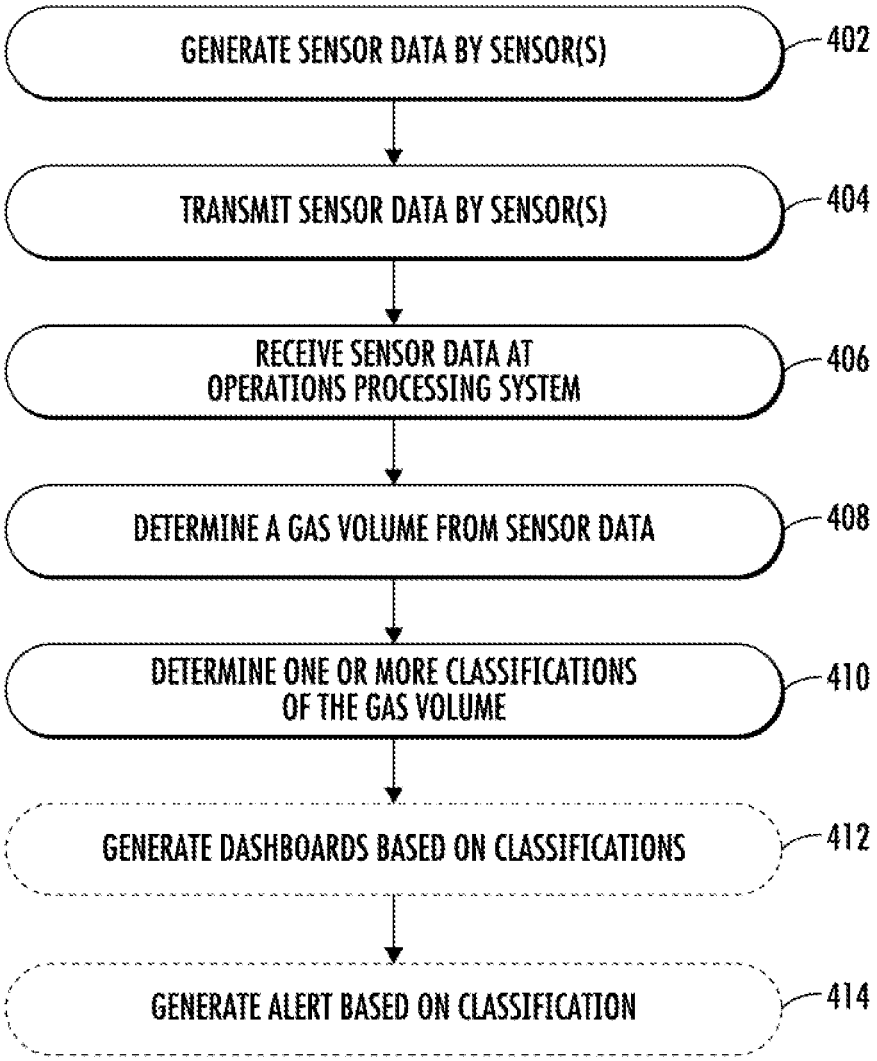
Figure 5:
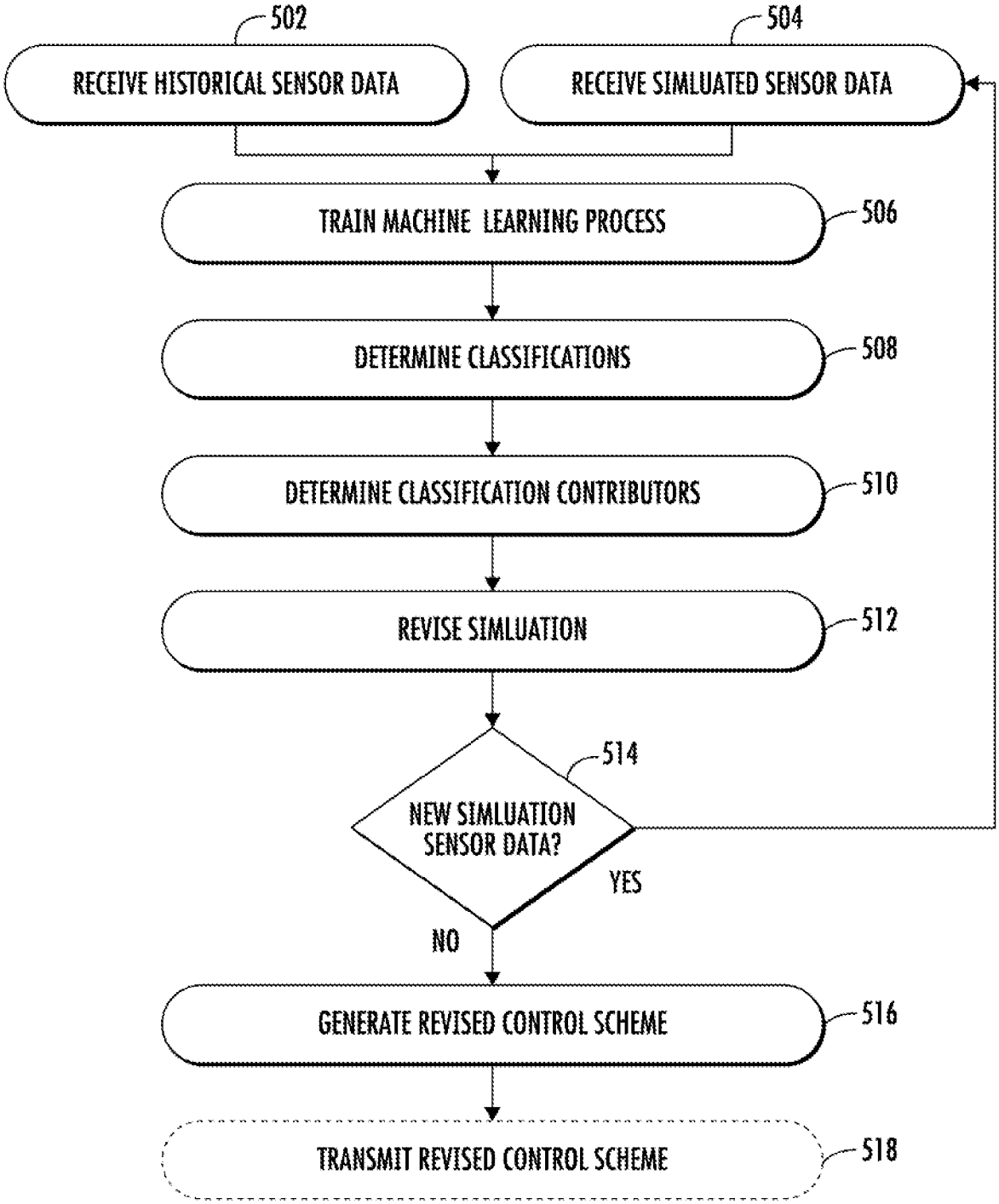

Having thus described certain example embodiments of the present disclosure in general terms, reference will now be made to the accompanying drawings, which are not necessarily drawn to scale, and wherein:

FIG. 1 illustrates an exemplary block diagram of an environment in which embodiments of the present disclosure may operate;

FIG. 2 illustrates an exemplary block diagram of an example apparatus that may be specially configured in accordance with an example embodiment of the present disclosure;

FIG. 3 illustrates an exemplary graph of volume slopes in accordance with an example embodiment of the present disclosure;

FIG. 4 illustrates a flowchart for determining a classification of a flaring or venting volume in accordance with one or more embodiments of the present disclosure; and FIG. 5 illustrates a flowchart for determining a classification contributor and a revised control scheme in accordance with one or more embodiments of the present disclosure.

DETAILED DESCRIPTION

Some embodiments of the present disclosure will now be described more fully herein with reference to the accompanying drawings, in which some, but not all, embodiments of the disclosure are shown. Indeed, various embodiments of the disclosure may be embodied in many different forms and should not be construed as limited to the embodiments set forth herein; rather, these embodiments are provided so that this disclosure will satisfy applicable legal requirements. Like reference numerals refer to like elements throughout.

As used herein, the term "comprising" means including but not limited to and should be interpreted in the manner it is typically used in the patent context. Use of broader terms such as comprises, includes, and having should be understood to provide support for narrower terms such as consisting of, consisting essentially of, and comprised substantially of.

The phrases "in one embodiment," "according to one embodiment," "in some embodiments," and the like generally mean that the particular feature, structure, or characteristic following the phrase may be included in at least one embodiment of the present disclosure and may be included in more than one embodiment of the present disclosure (importantly, such phrases do not necessarily refer to the same embodiment).

The word "example" or "exemplary" is used herein to mean "serving as an example, instance, or illustration." Any implementation described herein as "exemplary" is not necessarily to be construed as preferred or advantageous over other implementations.

If the specification states a component or feature "may," "can," "could," "should," "would," "preferably," "possibly," "typically," "optionally," "for example," "often," or "might" (or other such language) be included or have a characteristic, that a specific component or feature is not required to be included or to have the characteristic. Such a component or feature may be optionally included in some embodiments or it may be excluded.

The use of the term "circuitry" as used herein with respect to components of a system or an apparatus should be understood to include particular hardware configured to perform the functions associated with the particular circuitry as described herein. The term "circuitry" should be understood broadly to include hardware and, in some embodiments, software for configuring the hardware. For example, in some embodiments, "circuitry" may include processing circuitry, communication circuitry, input/output circuitry, and the like. In some embodiments, other elements may provide or supplement the functionality of particular circuitry. Alternatively or additionally, in some embodiments, other elements of a system and/or apparatus described herein may provide or supplement the functionality of another particular set of circuitry. For example, a processor may provide processing functionality to any of the sets of circuitry, a memory may provide storage functionality to any of the sets of circuitry, communications circuitry may provide network interface functionality to any of the sets of circuitry, and/or the like.

Overview

Environments including the flaring and/or venting of gases are the target of greenhouse gas emission reductions. For example, global sustainability initiatives include the reduction of emissions of greenhouse gases, such as hydrocarbons in the oil and gas industry. In accordance with the present disclosure, reductions in gas emissions may be based on the segregation of gas emission volumes associated with flaring and/or venting into one or more classifications.

A flaring and/or venting of a gas involves a volume of gas. The volume of gas flared and/or vented changes over the time the gas is flared and/or vented. In accordance with the present disclosure, determinations of the classifications of the flaring and/or venting may be based on these gas volumes. Such classifications many include routine, non-routine, and safety. These classifications may be based on changes associated with the gas volumes during flaring and/or venting.

In various embodiments, environments including the flaring and/or venting greenhouse gases may utilize operations processing systems and/or apparatuses to perform operations and/or functions associated with the classification, control, and/or reduction of the emission of one or more gases during flaring and/or venting. For example, plants flare gases to burn hydrocarbons, and such plants may include an operations processing system that may control the plant and/or related processing units (e.g., plant equipment, etc.) to not only control the flaring but also analyze the flaring and perform one or more operations for reducing the gas(es) flared. Additionally or alternatively, the operations processing systems may also perform one or more operations associated with include analyzing, tracking, accounting for, visualizing, reporting, and the like of gas emissions. Various operations performed by the operations processing systems may utilize machine learning techniques.

Some embodiments may capture data associated with a flaring and/or venting with one or more sensors. In various embodiments such sensors may include industrial sensors, such as cameras, pressure sensors, flow sensors, temperature sensors, and the like. These sensors may generate sensor data that may be used by the operations processing system. Various embodiments may determine one or more gas volumes from the sensor data and also utilize machine learning to segregate the gas volumes with classifications, such as routine, non-routine, and safety. Machine learning models utilized may be trained on historical data sets and/or simulation sensor data and then utilized to classify the sensor data. Various embodiments may include the machine learning models being trained to determine a classification based on changes in gas volumes during flaring and/or venting.

In various embodiments, operations processing systems may be associated with one site or, alternatively, associated with a plurality of sites. In various embodiments, an operations processing systems may allow for a user to monitor and analyze flaring and/or venting associated with a site. Additionally or alternatively, an operations processing systems may allow for a user to control processing units at a plant on a site. Additionally or alternatively, an operations processing system may allow for simulation of one or more scenarios associated with the operation of one or more sites, particular the plant(s) and processing units in a site. The simulations may be used to generate simulation data that may be used as input data into the machine learning model or to be used along with machine learning classifications.

In various embodiments, once an operations processing systems has classified a gas volume then the operations processing systems may allow for a user to investigate, analyze, and/or determine a source associated with the gas volume, which may include using one or more dashboards. This may allow for a user to determine and/or implement a control scheme to reduce the volume of gas(es) that may be flared and/or vented in the future. For example, various embodiments may assist in identifying fugitive leaks in processing equipment to alert a user to an unknown leak and/or maintenance items.

Additionally or alternatively, operations processing systems may be utilized to generate communications to one or more users. Such communications may include alerts, reports, the solicitation of feedback, and the like. The operations processing systems may also create visualizations of the sensor data and determinations generated by the operations processing systems to provide to the user. Such visualization may be available at the operations processing systems as well as on remote user devices, such as through dashboards. This may, for example, provide transparency regarding gas emissions, which may increase a user's ability to identify and take actions to reduce gas emissions.

Embodiments of the present disclosure provide a plurality of technical improvements and resolve a plurality of technical problems. As an example, allow for analysis of flaring and/or venting of gas volumes to identify how reductions to flaring and/or venting may be achieved.

Example Systems and Apparatuses

Embodiments of the present disclosure herein include systems, apparatuses, methods, and computer program products configured for and to perform one or more operations for segregation of flaring and venting volumes. It should be readily appreciated that the embodiments of the apparatus, systems, methods, and computer program product described herein may be configured in various additional and alternative manners in addition to those expressly described herein.

FIG. 1 illustrates an exemplary block diagram of an environment in which embodiments of the present disclosure may operate. Specifically, FIG. 1 illustrates a plant 102 that may be associated with a flare stack 104 ("stack 104"). The stack 104 may be used to flare and/or vent one or more gases. These gases may include, but are not limited to, greenhouse gases. Flaring of gases may generate a flame 110. The flame 110 of a stack 104 may be observed, measured, and/or analyzed by one or more sensors 120 in accordance with operations and/or functions described herein. A sensor 120 may generate and/or transmit sensor data across a network 130 to an operations processing system 140. The operations processing system 140 may be electronically coupled and/or communicatively coupled to one or more plant(s), for example to plant 102, one or more databases 150, and one or more user devices 160.

In some embodiments, the plant 102 may not include a stack 104. In some embodiments, the plant 102 may include any number of processing units that each perform different tasks for producing a final product (e.g., a blended, constructed, or otherwise combined product) from one or more input ingredients.

The plant 102 may, for example, be a hydrocarbon processing plant that receives and processes ingredients as inputs to create a final product. The plant 102 may generate waste gasses. In various embodiments, waste gasses may be released to atmosphere, such as through a stack 104 or at a processing unit. Alternatively, waste gases may be flared when being released to atmosphere. Additionally, or alternatively, flaring and venting of gases may occur at locations other than a stack 104. For example, smaller quantities of gases at other locations may be released or may leak into the atmosphere. In some embodiments, locations other than a stack 104 where gases may be vented and/or flared may include well heads, safety release valves, pipe headers, and/or the like.

The plant 102 may include any number of individual processing units. The processing units may each embody an asset or equipment of the plant 102 that performs a particular function during operation of the plant 102. For example in the example context of a particular oil refinery embodying the plant 102, the processing units may include a crude processing unit, a hydrotreating unit, an isomerization unit, a vapor recovery unit, a catalytic cracking unit, a aromatics reduction unit, a visbreaker unit, a storage tank, a blender, and/or the like that perform a particular operation for transforming, storing, and/or otherwise handling one or more input ingredient(s). In some embodiments, each processing unit of the plant 102 is associated with a determinable location. The determinable location of a particular unit in some embodiments represents an absolute position (e.g., GPS coordinates, latitude, longitude, and/or the like) or a relative position (e.g., a point representation of the location of a unit from a local origin point corresponding to the plant 102). In some embodiments, a processing unit includes or otherwise is associated with a location sensor and/or software-driven location services that provide the location data representing the location corresponding to that unit. In other embodiments the location of a unit is stored and/or otherwise predetermined within a software environment, provided by a user and/or otherwise determinable to one or more systems, for example including the operations processing system 140.

Additionally or alternatively, in some embodiments, the plant 102 is associated with a determinable location. The determinable location of the plant 102 in some embodiments represents an absolute position (e.g., GPS coordinates, latitude and longitude locations, an address, and/or the like) or a relative position of the plant (e.g., an identifier representing the location of the plant 102 as compared to one or more other plants, sites, an enterprise headquarters, or general description in the world for example based at least in part on continent, state, or other definable region). In some embodiments, the plant 102 includes or otherwise is associated with a location sensor and/or software-driven location services that provide the location data corresponding to the plant 102. In other embodiments, the location of the plant 102 is stored and/or otherwise determinable to one or more systems, for example including the operations processing system 140.

The flame 110 may be associated with flaring. Flaring involves the igniting and burning of concentrations of flammable gases. A gas may be comprised of a plurality of concentrations of individual gases, and some of these concentrations of individual gases may be flammable. Alternatively, a gas may be comprised of a concentration of an individual gas, which may or may not be flammable. In some embodiments, a gas may contain greenhouse gases, such as hydrocarbons. The hydrocarbons may be ignited by an ignition source, such as a pilot flame, when the gas passes by the ignition source. The ignited gas(es) may be referred to as flares, and this process may be referred to as flaring. In various embodiments, flaring may occur at the flaring stack 104, which may be at a high level of elevation from one or more other components of a plant 102, process area, piping, and the like associated with a site.

In embodiments with gases comprising hydrocarbons, the flaring of hydrocarbons will include lower emissions than the venting of the same gas(es). Flaring converts the hydrocarbons in the gas(es) to CO2 and water while venting does not change the composition of the waste gas to water. Thus the flaring may reduce the emissions of hydrocarbons into the atmosphere. In contrast to flaring, venting does not use combustion and, instead, is a direct release of gas(es) to the atmosphere. While FIG. 1 illustrates a flame 110, it will also be appreciated that by removing or omitting an ignition source, such as a pilot flame, gas(es) may be vented without flaring.

The one or more sensors 120 may include sensors to detect, capture, measure, and/or analyze data associated with operation of one or more plant(s) and/or one or more processing units. In one such example context, the sensors detect, capture, measure, and/or analyze a flame 110 and/or a gas emission. For example, a gas emission associated with a flaring and/or a venting. In some embodiments, a sensor 120 may include a camera, which may be configured to capture images and/or video in one or more spectrums of light. For example, a camera may be configured to capture images and/or video in the visible spectrum. Additionally or alternatively, a camera may be configured to capture images and/or video in the infrared spectrum. It will be appreciated that any number of sensor(s), sensor type(s), and/or the like may be utilized to monitor operations of a particular plant, and/or multiple plant(s).

In some embodiments, a sensor 120 (e.g., a camera) may be configured to perform or execute one or more operations and/or functions with determining a type, quantity, and/or volume of gas flared and/or emitted. For example, a camera may capture both visible light and infrared light to generate images and/or video of flaring. Based on these images and/or video of flaring, the camera may determine a type of gas being in a flame 110 as well as a volume of gas flared. In another example with a gas emission that is vented and not flared, a camera may capture both visible light and infrared light to generate images and/or video of venting. Based on these images and/or video of venting, the camera may determine a type of gas being in a flame 110 as well as a volume of gas flared. In various embodiments, a sensor 120 may generate sensor data (e.g., a camera generating images and/or video) and transmit the sensor data over a network 130.

The network 130 may be embodied in any of a myriad of network configurations. In some embodiments, the network 130 may be a public network (e.g., the Internet). In some embodiments, the network 130 may be a private a private network (e.g., an internal localized, or closed-off network between particular devices). In some other embodiments, the network 130 may be a hybrid network (e.g., a network enabling internal communications between particular connected devices and external communications with other devices). In various embodiments, the network 130 may include one or more base station(s), relay(s), router(s), switch(es), cell tower(s), communications cable(s), routing station(s), and/or the like. In various embodiments, components of the environment 100 may be communicatively coupled to transmit data to and/or receive data from one another over the network 130. Such configuration(s) include, without limitation, a wired or wireless Personal Area Network (PAN), Local Area Network (LAN), Metropolitan Area Network (MAN), Wide Area Network (WAN), and/or the like.

The operations processing system 140 may be located remotely or in proximity of a particular plant, for example the plant 102. In this regard, in some embodiments, the operations processing system 140 may be located remotely or in proximity to the emissions sources, such as flame 110. In some embodiments, the operations processing system 140 is configured via hardware, software, firmware, and/or a combination thereof, to perform data intake of one or more types of data associated with one or more plant(s), for example the plant 102. Additionally or alternatively, in some embodiments, the operations processing system 140 is configured via hardware, software, firmware, and/or a combination thereof, to generate and/or transmit command(s) that control, adjust, or otherwise impact operations of a particular plant or specific component(s) thereof, for example for controlling one or more operations of the plant 102 and/or processing units. Additionally or alternatively still, in some embodiments, the operations processing system 140 is configured via hardware, software, firmware, and/or a combination thereof, to perform data reporting and/or other data output process(es) associated with monitoring or otherwise analyzing operations of one or more processing plant(s), for example for generating and/or outputting report(s) corresponding to the operations performed via the plant 102. For example, in various embodiments, the operations processing system 140 may be configured to execute and/or perform one or more operations and/or functions described herein.

The one or more databases 150 may be configured to receive, store, and/or transmit data. In various embodiments, the one or more databases 150 may be associated with sensor data received from sensors 120. The sensor data stored by the one or more databases 150 may include historical sensor data as well as current and/or real-time sensor data. Additionally or alternatively, in some embodiments the one or more databases 150 store user inputted data associated with operations of one or more plant(s). In some embodiments, the one or more databases 150 store data associated with multiple individual plant(s), for example multiple plants associated with the same enterprise entity but located in different geographic locations across the world.

The one or more user devices 160 may be associated with users of the operations processing system 140. In various embodiments, the operations processing system 140 may generate and/or transmit a message, alert, or indication to a user via a user device 160. Additionally, or alternatively, a user device 160 may be utilized by a user to remotely access an operations processing system 140. This may be by, for example, an application operating on the user device 160. A user may access the operations processing system 140 remotely, including one or more visualizations, dashboards, reports, and/or real-time displays.

Additionally, while FIG. 1 illustrates certain components as separate, standalone entities communicating over the network 130, various embodiments are not limited to this configuration. In other embodiments, one or more components may be directly connected and/or share hardware or the like. For example, in some embodiments, the operations processing system 140 may include one or more databases 150, which may collectively be located in or at the plant 102.

In various embodiments, a plant 102 may also include additional sensors that may be used by the operations processing system 140 for segregating flaring and venting volumes. These additional sensors may be dependent on the processing unit(s) used by a plant. For example, the sensors may include pressure sensors, air flow sensors, gas sensors (e.g., methane sensors), temperature sensors, and the like. Each of the sensors may generate sensor data, which may differ and may be based on the type of sensor (e.g., pressure sensors generate pressure data, etc.). In various embodiments, a sensor may be configured to perform one or more operations analyzing the sensor data. Alternatively, or additionally, a sensor may be configured to transmit sensor data to the operations processing system 140 for analysis.

FIG. 2 illustrates an exemplary block diagram of an example apparatus that may be specially configured in accordance with an example embodiment of the present disclosure. Specifically, FIG. 2 depicts an example computing apparatus 200 ("apparatus 200") specially configured in accordance with at least some example embodiments of the present disclosure. Examples of an apparatus 200 may include, but is not limited to, a sensor 120, an operations processing system 140, a database 150, and/or a user device 160. The apparatus 200 includes processor 202, memory 204, input/output circuitry 206, communications circuitry 208, and/or optional machine learning circuitry 210. In some embodiments, the apparatus 200 is configured to execute and perform the operations described herein.

Although components are described with respect to functional limitations, it should be understood that the particular implementations necessarily include the use of particular computing hardware. It should also be understood that in some embodiments certain of the components described herein include similar or common hardware. For example, in some embodiments two sets of circuitry both leverage use of the same processor(s), memory(ies), circuitry(ies), and/or the like to perform their associated functions such that duplicate hardware is not required for each set of circuitry.

In various embodiments, such as an computing apparatus 200 of an operations processing system 140 or of a user device 160 may refer to, for example, one or more computers, computing entities, desktop computers, mobile phones, tablets, phablets, notebooks, laptops, distributed systems, servers, or the like, and/or any combination of devices or entities adapted to perform the functions, operations, and/or processes described herein. Such functions, operations, and/or processes may include, for example, transmitting, receiving, operating on, processing, displaying, storing, determining, creating/generating, monitoring, evaluating, comparing, and/or similar terms used herein. In one embodiment, these functions, operations, and/or processes can be performed on data, content, information, and/or similar terms used herein. In this regard, the apparatus 200 embodies a particular, specially configured computing entity transformed to enable the specific operations described herein and provide the specific advantages associated therewith, as described herein.

Processor 202 or processor circuitry 202 may be embodied in a number of different ways. In various embodiments, the use of the terms "processor" should be understood to include a single core processor, a multi-core processor, multiple processors internal to the apparatus 200, and/or one or more remote or "cloud" processor(s) external to the apparatus 200. In some example embodiments, processor 202 may include one or more processing devices configured to perform independently. Alternatively, or additionally, processor 202 may include one or more processor(s) configured in tandem via a bus to enable independent execution of operations, instructions, pipelining, and/or multithreading.

In an example embodiment, the processor 202 may be configured to execute instructions stored in the memory 204 or otherwise accessible to the processor. Alternatively, or additionally, the processor 202 may be configured to execute hard-coded functionality. As such, whether configured by hardware or software methods, or by a combination thereof, processor 202 may represent an entity (e.g., physically embodied in circuitry) capable of performing operations according to embodiments of the present disclosure while configured accordingly. Alternatively, or additionally, processor 202 may be embodied as an executor of software instructions, and the instructions may specifically configure the processor 202 to perform the various algorithms embodied in one or more operations described herein when such instructions are executed. In some embodiments, the processor 202 includes hardware, software, firmware, and/or a combination thereof that performs one or more operations described herein.

In some embodiments, the processor 202 (and/or co-processor or any other processing circuitry assisting or otherwise associated with the processor) is/are in communication with the memory 204 via a bus for passing information among components of the apparatus 200.

Memory 204 or memory circuitry 204 may be non-transitory and may include, for example, one or more volatile and/or non-volatile memories. In some embodiments, the memory 204 includes or embodies an electronic storage device (e.g., a computer readable storage medium). In some embodiments, the memory 204 is configured to store information, data, content, applications, instructions, or the like, for enabling an apparatus 200 to carry out various operations and/or functions in accordance with example embodiments of the present disclosure.

Input/output circuitry 206 may be included in the apparatus 200. In some embodiments, input/output circuitry 206 may provide output to the user and/or receive input from a user. The input/output circuitry 206 may be in communication with the processor 202 to provide such functionality. The input/output circuitry 206 may comprise one or more user interface(s). In some embodiments, a user interface may include a display that comprises the interface(s) rendered as a web user interface, an application user interface, a user device, a backend system, or the like. In some embodiments, the input/output circuitry 206 also includes a keyboard, a mouse, a joystick, a touch screen, touch areas, soft keys a microphone, a speaker, or other input/output mechanisms. The processor 202 and/or input/output circuitry 206 comprising the processor may be configured to control one or more operations and/or functions of one or more user interface elements through computer program instructions (e.g., software and/or firmware) stored on a memory accessible to the processor (e.g., memory 204, and/or the like). In some embodiments, the input/output circuitry 206 includes or utilizes a user-facing application to provide input/output functionality to a computing device and/or other display associated with a user.

Communications circuitry 208 may be included in the apparatus 200. The communications circuitry 208 may include any means such as a device or circuitry embodied in either hardware or a combination of hardware and software that is configured to receive and/or transmit data from/to a network and/or any other device, circuitry, or module in communication with the apparatus 200. In some embodiments the communications circuitry 208 includes, for example, a network interface for enabling communications with a wired or wireless communications network. Additionally or alternatively, the communications circuitry 208 may include one or more network interface card(s), antenna(s), bus(es), switch(es), router(s), modem(s), and supporting hardware, firmware, and/or software, or any other device suitable for enabling communications via one or more communications network(s). In some embodiments, the communications circuitry 208 may include circuitry for interacting with an antenna(s) and/or other hardware or software to cause transmission of signals via the antenna(s) and/or to handle receipt of signals received via the antenna(s). In some embodiments, the communications circuitry 208 enables transmission to and/or receipt of data from a user device, one or more sensors, and/or other external computing device(s) in communication with the apparatus 200.

Machine learning circuitry 210 may be included in the apparatus 200. The machine learning circuitry 210 may include hardware, software, firmware, and/or a combination thereof designed and/or configured to request, receive, process, generate, and transmit data, data structures, control signals, and electronic information for training and executing a trained machine learning model configured to facilitating the operations and/or functionalities described herein. For example, in some embodiments the machine learning circuitry 210 includes hardware, software, firmware, and/or a combination thereof, that identifies training data and/or utilizes such training data for training a particular machine learning model, artificial intelligence (AI), and/or other model to generate particular output data based at least in part on learnings from the training data. Additionally or alternatively, in some embodiments, the machine learning circuitry 210 includes hardware, software, firmware, and/or a combination thereof, that embodies or retrieves a trained machine learning model, AI, and/or other specially configured model utilized to process inputted data. Additionally or alternatively, in some embodiments, the machine learning circuitry 210 includes hardware, software, firmware, and/or a combination thereof that processes received data utilizing one or more algorithm(s), function(s), subroutine(s), and/or the like, in one or more pre-processing and/or subsequent operations that need not utilize a machine learning or model.

Data intake circuitry 212 may be included in the apparatus 200. The data intake circuitry 212 may include hardware, software, firmware, and/or a combination thereof, designed and/or configured to capture, receive, request, and/or otherwise gather data associated with operations of one or more plant(s). In some embodiments, the data intake circuitry 212 includes hardware, software, firmware, and/or a combination thereof, that communicates with one or more sensor(s). unit(s), and/or the like within a particular plant to receive particular data associated with such operations of the plant. The data intake circuitry 212 may support such operations for any number of individual plants. Additionally or alternatively, in some embodiments, the data intake circuitry 212 includes hardware, software, firmware, and/or a combination thereof, that retrieves particular data associated with one mor more plant(s) from one or more data repository/repositories accessible to the apparatus 200.

Data output circuitry 214 may be included in the apparatus 200. The data output circuitry 214 may include hardware, software, firmware, and/or a combination thereof, that configures and/or generates an output based at least in part on data processed by the apparatus 200. In some embodiments, the data output circuitry 214 includes hardware, software, firmware, and/or a combination thereof, that generates a particular report based at least in part on the processed data, for example where the report is generated based at least in part on a particular reporting protocol. Additionally or alternatively, in some embodiments, the data output circuitry 214 includes hardware, software, firmware, and/or a combination thereof, that configures a particular output data object, output data file, and/or user interface for storing, transmitting, and/or displaying. For example, in some embodiments, the data output circuitry 214 generates and/or specially configures a particular data output for transmission to another system sub-system for further processing. Additionally or alternatively, in some embodiments, the data output circuitry 214 includes hardware, software, firmware, and/or a combination thereof, that causes rendering of a specially configured user interface based at least in part on data received by and/or processing by the apparatus 200.

In some embodiments, two or more of the sets of circuitries 202-214 are combinable. Alternatively, or additionally, one or more of the sets of circuitry 202-214 perform some or all of the operations and/or functionality described herein as being associated with another circuitry. In some embodiments, two or more of the sets of circuitry 202-214 are combined into a single module embodied in hardware, software, firmware, and/or a combination thereof. For example, in some embodiments, one or more of the sets of circuitry, for example the machine learning circuitry 210, may be combined with the processor 202, such that the processor 202 performs one or more of the operations described herein with respect the machine learning circuitry 210.

In various embodiments, a gas volume of a flaring and/or venting may be segregated into various classifications, including but not limited to routine, non-routine, and safety. A determination of whether flaring or venting is classified as routine, non-routine, or safety may be based on, among things, current sensor data and/or historical sensor data. For example, a machine learning process may be used to generate and/or determine a classification. The machine learning process may include a machine learning model that may be trained using current sensor data and/or historical sensor data.

In various embodiments, the classification of a flaring and/or venting may be associated with one or more categories and/or subcategories as well as one or more tags. The tags and/or classifiers may be utilized with the operations processing system 140, including for machine learning processes and/or data visualization. For example, the operations processing system 140 may associate a flaring tagged as routine with one or more processing units and one or more dashboards may present this information to a user, including the processing unit being a contributor to the flaring.

Sensor data of flaring and/or venting is collected by one or more sensors 120. For example, the sensor data may include a flaring volume or a venting volume. In various embodiments, a flaring volume and/or venting volume may refer to an amount of a gas associated with a flame 110 during a flaring event or a venting during a venting event. As a flaring and/or venting event occurs, the flaring volume and/or venting volume may change over time. Thus the gas volume may be determined over time. The change in volume includes a volume slope change. As the flaring and/or venting begins the slope of the gas volume will increase or be positive as the volume of gas reaches the ignition source and ignites. As the flaring and/or venting ends the slope of the gas volume will decrease or be negative. From looking at the profile and/or the slope of volume changes with machine learning. The sensor data of a flaring event and/or venting event may be determined to be routine, non-routine, and/or safety. In various embodiments, the machine learning may also take into account additional sensor data, such as data associated with one or more processing units, the plant 102, sensors 120, and/or an environment in which a flare and/or venting occurs.

In various embodiments, the slopes of volumes recorded may be sorted from the highest volume slope to the lowest volume slope. This may be a sorting based on a percentage change. Alternatively or additionally, it may be a sorting based on absolute values. After sorting, a highest slope (e.g., most positive) may be at the top of the sorting and a lowest slope (e.g., most negative) will be at the bottom of the sorting. In various embodiments, most of the volume slopes will not be near the extremes. Thresholds may be used to segregate regions of a sorting.

FIG. 3 illustrates an exemplary graph of volume slopes in accordance with an example embodiment of the present disclosure. The graph 300 in FIG. 3 includes a plurality of volume slopes plotted onto the graph 300. In various embodiments, the x-axis may represent a sample number associated with one volume slope of one flare volume event. The y-axis may represent a flared delta volume or volume slope. In the illustrated embodiment for graph 300, there may be 7,500 samples of flaring and/or venting events. The graph 300 includes a first threshold 310 and a second threshold 320. For example, the first threshold may indicate the top 50% of volume slopes and the second threshold may indicate the top 90% of volume slopes. The first threshold may correspond with, for example, 400 samples that have a volume slope in the top 50% of volume slopes. The second threshold may correspond with, for example, 2,296 samples that have a volume slope in the top 90% of volume slopes. It will readily be appreciated that other thresholds may be chosen.

In various embodiments, segregation of a gas volume may be based on a volume slope. For example, segregation may be based on a sudden jump, surge, or transition of a flare volume and/or vent volume above a first threshold 310 and/or below a second threshold 320. The volume slopes for flaring and/or venting may be recorded over time from sensor data. A classification may be associated with a region of the graph 300. For example, above (i.e., to the left of) the first threshold 310 may be a first region, between the first threshold 310 and the second threshold 320 may be a second region, and below (i.e., to the right of) the second threshold 320 may be a third region. Classification of a volume slope may be based on a percentage difference in the change in volume, which may be a volume slope. For example, a first threshold may be at 50% and a second threshold may be at 90%. When a flare volume detected changes in volume from a first region above 50% to, for example, below either 50% or below 90%, then the flare volume may be segregated into a routine flaring event. In various embodiments, there may be a clear demarcation between the classifications of safety volume slopes, non-routine volume slopes, and routine volume slopes. Such demarcations may be present in, for example, current and/or historical sensor data used for training and/or operating a machine learning model. For example, safety volume slopes may be around 1.5% (e.g., 1.5% of the samples of volumes slopes), non-routine volume slopes may be around 13% (e.g., 13% of the samples of volumes slopes), and the remainder of 85.5% may be routine volume slopes (e.g., 85.5% of the samples of volumes slopes). Such percentages may or may not be used for determining one or more thresholds. Additionally or alternatively, a routine flaring event may also be based on other sensor data received by the operations control system.

In various embodiments, a segregation of the flaring and/or venting into one or more classifications may alternatively be based on, among other things, the first threshold 310 and the second threshold 320. For example, routine flaring and/or venting may be classified as those with a volume slope above the first threshold 310. The non-routine flaring and/or venting may be classified as those with a volume slope below the first threshold 310.

In various embodiments, an operations processing system 140 may focus on determining a classification of routine flaring and/or venting. The focus on classifying routine flaring and/or venting may be due to the routine classification being the clearest to reduce. Safety flaring and/or venting may be difficult to reduce as it may be associated with safety equipment that may need to operate to allow for safe operation of a plant 102.

There may be multiple contributors to each classification of flaring and/or venting. In various embodiments, once routine flaring and/or venting has been classified, then the contributors to the volume of gas associated with the routine flaring and/or venting may be determined. Alternatively or additionally, a machine learning process may incorporate additional sensor data into the machine learning process to identify contributors as a part of determining one or more classifications.

In some embodiments, contributors to flaring and/or venting may be associated with one or more of the processing units of the plant 102. For example, a contributor to routine flaring may be related to fuel. Fuel may be supplied to and/or supplied from a fuel gas header. Typically a fuel gas header may need to be maintained at a specific pressure to distribute fuel to one or more additional processing units. In some embodiments, a fuel gas header may provide fuel to additional process units, such as a flooding header. To keep the fuel gas header at the specific pressure, fuel may need to be added to the fuel gas header. A flaring header may also need to be maintained at a specific pressure. In order to maintain those pressures, we need to we need to put more fuel gas or excess gas into the fuel gas header. However, the additional fuel gas into the fuel gas header may result in excess pressure. The excess pressure may result in additional flaring. In this example, the excess fuel added may be a contributor.

Further examples of contributors may include one or more valves. For example, a valve may be a passing valve. Valves may have a fully open position, a fully closed position, and a range of positions in between fully open and fully closed. In some embodiments, a passing valve may be a valve with internal seals or other internal components that may be comprised. Such comprised valve internals may unintentionally pass, for example, a gas or fluid through the valve when the valve is in a fully closed position. In terms of sensor data, valve passing may be difficult to determine because there may be no signal to the operations control system 140 or the like attached to the valve generating an indication of valve passing. Instead, valve passing may be simulated using one or more simulations. A simulation may allow for comparing a valve and/or simulating if the valve is passing. Such a use of a simulation may confirm if valve passing is occurring by comparing a pressure in sensor data downstream of the valve with a pressure if the valve is fully closed. In an example, a valve may be in a pipe for transferring a gas. There may be no other valves in a downstream pipe that may add gas. Further downstream may be a pressure sensor, and a pressure measurement may be greater than zero when the valve is fully closed. Thus, a pressure measurement from the pressure sensor matching the simulation determines that the valve is passing.

Another contributor to routine flaring and/or venting may be equipment degradation. Equipment fails over time with wear and tear. As equipment fails, the equipment's efficiency degrades. This may cause the cost of the equipment to rise as the equipment may have to work harder by expending more energy, which may also include requiring more fuel to supply that energy. Such degradation may also be simulated.

In various embodiments, sensor data for a processing unit (e.g., a valve) may not be directly available. Simulations performed for operation of the plant 102 may generate simulated sensor data to may be used, such as a simulated follow sensor for a leaking valve. In some embodiments, a leaking vale may be referred to as a fugitive leak. Sensors may be used to detect fugitive leaks. A fugitive leak may be associated with a piece of equipment that has a small leak, such as around or near a seal, wall, flange, and the like. In various embodiments, a fugitive leak may be associated with a pin-hole aperture in a pipe or piece of equipment through which gas may leak.

In various embodiments, a flare volume and/or venting volume may be made up of one or more volumes associated with routine, non-routine, and/or safety. For example, a plant 102 may utilize a single flare stack 104. A flare 110 at the flare stack 104 may have a flare volume of 100 $m^3$. This 100 $m^3$ may be comprised of a routine flaring volume and a non-routine flare volume. Additionally information about one or more gas volumes being flared at the flare stack 104 may be in sensor data and/or simulation data generated at a plant 102 and/or an operations processing system 140. For example, a non-routine situation may include a process valve opened to some extent because of pressure an associated processing unit not fully sealed. Thus some gas may leak through this process valve and contribute to a flare 110. Additionally, a routine opening of a second valve may contribute gas to the flare 110. The operations processing system 140 may utilize the sensor data to segregate the gas volumes and identify the associated processing units.

In various embodiments, the operations processing system 140 may first classify safety flaring and/or venting before making other classifications. Classifying the values above a first threshold 310 and below a second threshold 320 may be associated with safety flaring and/or venting. This may be due to safety flaring and/or venting associated with a safety event requiring an immediate flaring and/or venting of a gas with a large increase in volume slope and then a large decrease in volume slope. After classifying safety volume slopes, then the routine and non-routine volume slopes may be classified. In some embodiments, one or more additional thresholds may be used to determine a baseline or minimum flare and/or venting volume that is consistently present. An example may include a volume of gas needed to keep a flare light. The baseline may be associated with non-routine flaring and/or venting. Then an amount of a flare and/or venting volume slop above this baseline may be determined. Thus, the routine and the non-routine may be segregated.

Once a volume of gas emissions associated with routine flaring and/or routine venting is determined, the operations processing system 140 may determine one or more contributors associated with the routing flaring and/or routing venting. Sensor data from additional sensors may be used by the operations processing system 140 to determine the contributors. In various embodiments, machine learning may analyze the sensor data and determine the contributors.

Example Operations

In some example embodiments, and according to the operations described herein, flaring and/or venting gas volumes may be segregated, including by using machine learning. While the following flowcharts and related description includes multiple operations, it is readily appreciated that some of the following operations may be omitted, some of the operations may be repeated or iterated, and that additional operations may be included. Additionally, the order of operations should not be interpreted as limiting as the order of these operations may be varied.

In various embodiments, machine learning may be trained to segregate flaring and/or venting gas volumes into classifications. The machine learning may be utilized to determine a classification and/or a contributor to the flaring and/or venting. An operations processing system 140 may use the classifications to generate one or more electronic communications (e.g., alerts) and/or generate one or more visualizations associated with the classification(s) (e.g., dashboards) that may be provided to a user.

FIG. 4 illustrates a flowchart for determining a classification of a flaring or venting volume in accordance with one or more embodiments of the present disclosure.

At operation 402, sensor data may be generated by sensors. One or more sensors may be used to generate sensor data. For example, a sensor of a camera may generate images and/or video. As another example, a position sensor, such as on a valve, may generate a signal if a valve is open, closed, or in another position. As yet another example, a flow rate sensor may generate a signal associated with a flow (e.g., a flow rate).

In various embodiments, one or more sensors may observe a flame 110 and/or a venting of gas. For example, a camera may be used to image and/or record gas emissions. The camera may generate images and/or videos a gas emission cloud associated with the gas emission. An image and/or video may include a gas cloud. A gas cloud may include multiple different gases. A camera may generate images in more than one light spectrum. For example, a camera may capture images in the visible light spectrum and in the infrared light spectrum. The sensor data across the various spectrum may be used to determine volumes associated with different gases. The emissions sensor may be configured to and may determine the composition of the gas cloud by identifying the different gases in the gas cloud. The composition may include a weight and/or volume of each gas identified in the gas cloud.

In various embodiments, the cameras may include a zoom function that may allow the camera to remotely monitor various points. For example, a camera may have a zoom function allowing it to zoom to a distance of 5,000 feet. With zoom functionality, a camera may generate sensor data for a plurality of flaring and/or venting locations. In some embodiments, the sensor data generated may include and/or be tagged with metadata indicating a location (e.g., GPS) as well as sensor used to generate the sensor data.

At operation 404, sensor data may be transmitted from the sensor. A sensor may generate the sensor data and then transmit the sensor data. The sensor data may be transmitted to an operations processing system 140. Alternatively or additionally, sensor data may be transmitted from one or more sensors to one or more databases 150. The sensor data may be transmitted via a network 130. In some embodiments, the sensor data may be packaged into one or more sensor data objects. The sensor data objects may be encrypted. In some embodiments, the sensor data may be transmitted in response to a request for the sensor data received from the operations processing system 140.

At operation 406, sensor data may be received by the operations processing system. 140. In various embodiments, if the sensor data was encrypted, the sensor data may be unencrypted. In various embodiments, an operations processing system 140 may receive sensor data from one or more sensors. Additionally, one or more sensor data may be determined to be related to a flare and or venting event. This may be determine by, for example, tagging of the sensor data, metadata for the sensor data, and/or a determination the sensor that transmitted the sensor data. Alternatively or additionally, in various embodiments with multiple sensors, the sensor data from the multiple sensors may be received and combined to generate combined sensor data. The sensor data received may allow for real-time continuous monitoring of processing units. For example, a flare stack may be monitored continuously to capture sensor data related to a flame 110 flaring gas.

Alternatively or additionally, in some embodiment sensor data may be simulated. For example, a pressure, flow rate, temperature, and the like may be simulated with a simulation of a plant 102. The simulation may be simulated by the operations processing system 140. Alternatively, the simulation be simulated and the simulated sensor data may be provided from the simulation to the operations processing system 140.

At operation 408, a gas volume may be determined from sensor data. For example, sensor data from a camera may include images and/or video in the visible light spectrum and the infrared spectrum. In various embodiments, the sensor may be configured to determine one or more gases, concentrations, and/or volumes in an observed flaring and/or venting. Thus the sensor data received may include a gas volume. The operations processing system 140 may identify the gas volume based on, for example, metadata and/or tagging associated with the sensor data.

Alternatively or additionally, various embodiments may include the operations processing system 140 determining a gas volume from images and/or video in the sensor data. In some embodiments, the sensor data may include images and/or video associated with a flame 110 and/or a flaring event, including a flare profile. The flare profile may be utilized to determine a gas volume. For example, the size, temperature, and profile of the flare may be utilized to determine a gas volume over a period of time. Additionally or alternatively, weather conditions may compensated for. For example, if there is high wind, the high wind may be compensated for.

At operation 410, one or more classification of the gas volume may be determined. The gas volume may be used to determine one or more classifications. As described herein, such as with regard to FIG. 3, a volume slope of a gas volume may be used to determine a classification. Alternatively or additionally, a flare may be used to determinate classification, with one or more portions of a flare being related to a gas volume.

In various embodiments, machine learning processes may be used to determine a classification. The machine learning processes may be trained based on sensor data received and/or simulated sensor data to determine when a volume slope is associated with a classification. For example, based on camera sensor data received and sensor data associated with safety processing units, flaring and/or venting may be determined to be associated with a safety process. If a safety valve opened due to a safety event, the operations processing system 140 may determine that a flaring volume and/or venting volume matching an amount of gas measured to be released by the safety valve may be classified as safety gas volume. Similarly, machine learning may be trained to monitor additional contributors and determine additional classifications, including but not limited to as routine and non-routine.

At operation 412, dashboards may be generated based on the classifications. An operations processing system 12 may include one or more dashboards that may be presented to a user. Dashboards may include, for example, a site selection dashboard, a gas emissions dashboard, a monetization dashboard, and the like. The dashboard may present a user different information and/or data about a flaring and/or venting event.

A site selection dashboard may be generated to provide a user with one or more sites monitored by the operations processing system 140. Various sites may be represented by various indicators. An indicator may be emphasized based on gas emissions related to the site. For example, an indicator may be colored circle with a first color (e.g., green) if the site is meeting one or more emissions targets or a second color (e.g., red) if the site is not meeting one or more emission targets. Further, a site selection dashboard may provide an alert or indication depending on a type of classification of one or more gas volume determined. For example, an alert or indicator may be associated with a safety classification of a recent flaring and/or venting event.

In some embodiments, a site selection dashboard may also render a top-down view of a site. The top-down view may include a plurality of representations of different processing units associated with a site. Each of the representations may be selected by a user and, on receiving a user selection, the dashboard may drill down to the individual processing unit. On drilling down, gas emission data associated with the processing unit may be presented, including a classification of the gas emission as safety, routine, and/or non-routine. Additionally or alternatively, various embodiments may include rendering sensor data associated with the gas emissions for the displayed processing unit. Such sensor data may include images and/or videos from a camera capturing such sensor data depicting a gas emission could from the equipment. In some embodiments, the rendering of an image and/or video may provide a location where one or more of the processing units may be venting gas to the atmosphere.

A gas emissions dashboard may present a user with information and/or data associated with gas emissions for a site, plant 102, and/or processing unit. Alternatively or additionally, a gas emissions dashboard may be for all of the sites associated with an operations processing system 140.

A monetization dashboard may present a user with a cost of the gas emissions. The cost may be broken out by classification, with each classification being rendered separately and associated with its own cost. The cost may be determined based on a value of the one or more gas volumes flared and/or vented. For example, a volume of a first gas may be determined and a monetization of that quantity may be determined based on a gas price. A gas price may be a current price, a historical price, an estimated price, and/or the like. In some embodiments, the monetization dashboard may present a user with the value of one or more lost gases due to flaring and/or venting. In some embodiments, historic values may be utilized to determine an estimate value of future flaring and/or venting. For example, historical quantities may include flaring 5% of a volume, and that 5% of a volume may be monetized. This monetization may be used to analyze cost savings in a reduction of flaring and/or venting volumes.

In various embodiments, a monetization dashboard may include a determination of a savings of implementing a control scheme to reduce gas emissions. As described herein, control schemes for reducing emission based on classifications may be generated. The operations processing system 140 may determine a savings by implementing the control scheme, such as to reduce routine flaring and/or venting, and this savings may be presented to a user via a monetization dashboard.

At operation 414, an alert may be generated based on the classifications. Various embodiments may generate alerts for the classification of safety and routine classifications. An alert may also identify one or more processing units associated with the gas emission(s). The alert may be incorporated into a dashboard (e.g., flashing indicator). The alert may be an electronic communication that may be transmitted to a user, such as to a user device 160 where it may be rendered.

In various embodiments, one or more simulations may utilize the sensor data. Such simulations may include simulated gas emissions. The simulations may allow for modeling of plant processes with current sensor data, historical sensor data, and with modifications, such as a reduction to a contributor to flaring and/or venting. In various embodiments, simulations may include one or more control schemes for how to adjust and/or alter a process to achieve a reduction in gas emissions that would otherwise be flared or vented. The simulations may also be used to generate dashboards as described herein. These simulated dashboard screens may include projections of gas emissions for a period of time (e.g., days, months, quarters, years, etc.).

In various embodiments, a simulation model may be used as an input contributor to the machine learning process. The simulation data may also be used to investigate a contributor of the routine flaring and to reduce the amount of routine flaring.

In various embodiments, machine learning processes may be use historical sensor data, simulation sensor data, and current sensor data. For example, a machine learning process may utilize one or more neural networks to model classification of flaring and/or venting gas volumes with other sensor data received. Thus the machine learning model may allow for identification of one or more contributors to a flaring and/or venting event. For example, the machine learning model may be trained to identify a processing unit (e.g., header, valve, etc.) as a contributor to providing gas while identify other processing units as not being contributors.

The machine learning model may also be trained to generate scenarios where one or more contributors have been identified. A scenario may include a determined relationship between the flaring and/or venting and a contributor. The relationship may include a measured and/or estimated gas contribution to the flaring and/or venting.

Various embodiments may include one or more of the sensor data being generated by a simulation. For processing units that do not have a certain type of sensor (e.g., flow rate sensor) or that may be experiencing loss of efficiency and/or degradation (e.g., valve passing), sensor data may be simulated. A simulation may simulate a site and/or a plant 104. The simulation may simulate a plurality of scenarios, including scenarios generated by the machine learning model. In some embodiments, a simulation may also generate a strategy to reduce emissions. A strategy may include varying settings, controls, tunings, and the like of one or more process units. Additionally or alternatively, a strategy may be generated in response to a classification of flaring and/or venting. For example, after a classification of a routine flaring, a simulation may generate a strategy for how to reduce and/or prevent such a flaring going forward. The simulation may generate simulation output, which may include tuning and/or settings for one or more process units that may be loaded to reduce routine flaring. In various embodiments, the simulation output may include simulated sensor data that may be used to train and/or retrain a machine learning model.

FIG. 5 illustrates a flowchart for determining a classification contributor and a revised control scheme in accordance with one or more embodiments of the present disclosure.

At operation 502, historical sensor data may be received. In various embodiments, historical sensor data may be received from a database 150.

At operation 504, simulation sensor data may be received. The simulation sensor data may be generated by one or more simulations. The simulations may output the simulation sensor data based on one or more simulations. Such simulations may simulate one or more scenarios.

At operation 506, a machine learning process may be trained. A machine learning process may include a machine learning model. The machine learning model may be trained with training data. In various embodiments, the training data may include historical sensor data, simulated sensor data, and/or historical sensor data and simulated sensor data. Once trained, the machine learning model may be used in operated.

At operation 508, classifications may be determined. Classifications may be determined based on sensor data. For example, sensor data may be input into the machine learning model and the machine learning model may output a classification. In various embodiments, a classification may be a segregation of a flaring and/or venting gas volume as routine, non-routine, and/or safety.

At operation 510, classification contributors may be determined. A machine learning model may determine one or more contributors to one or more classifications of flaring and/or venting events associated with a determined classification. For example, if a determine of a routine flaring was determined at operation 508, operation 510 may determine one or more contributors associated with the routine flaring.

At operation 512, the simulation may be revised. In various embodiments, revising a simulation may be based on one or more classifications of flaring and/or venting. Additionally or alternatively, a simulation may be revised based on the identification of one or more contributors to flaring and/or venting. In some embodiments, a revised simulation may be to incorporate additional contributors identified and/or incorporate relationships between flaring and/or venting and one or more contributors.

At operation 514, a determination of if there is new simulated sensor data may be made. If there is new simulated sensor data, then the new simulated sensor data may be incorporated into the machine learning process, such as by being transmitted to operation 504. If there is no new simulated sensor data, then the process may proceed to operation 516.

At operation 516, a revised control scheme may be generated. The simulation, having been revised, may simulate one or more control scheme to operate a plant 104 and/or one or more processing units. The revised control scheme may include inputs, settings, commands, or the like to be loaded to a processing unit or a controller of a processing unit (e.g., a PLC and/or distributed control system (DCS)).

At operation 518, the revised control scheme may be transmitted. For example, a control scheme may be implement on, loaded to, and/or execute by individual processing units. Thus the revised control scheme may be transmitted to the processing units for use in operation of the processing units. In some embodiments, the operations control system 140 may control the processing units and, thus, the control scheme does not need to be transmitted to be implements. In such embodiments, the control scheme may be implemented by the operations processing system 140.

Operations and/or functions of the present disclosure have been described herein, such as in flowcharts. As will be appreciated, computer program instructions may be loaded onto a computer or other programmable apparatus (e.g., hardware) to produce a machine, such that the resulting computer or other programmable apparatus implements the operations and/or functions described in the flowchart blocks herein. These computer program instructions may also be stored in a computer-readable memory that may direct a computer, processor, or other programmable apparatus to operate and/or function in a particular manner, such that the instructions stored in the computer-readable memory produce an article of manufacture, the execution of which implements the operations and/or functions described in the flowchart blocks. The computer program instructions may also be loaded onto a computer, processor, or other programmable apparatus to cause a series of operations to be performed on the computer, processor, or other programmable apparatus to produce a computer-implemented process such that the instructions executed on the computer, processor, or other programmable apparatus provide operations for implementing the functions and/or operations specified in the flowchart blocks. The flowchart blocks support combinations of means for performing the specified operations and/or functions and combinations of operations and/or functions for performing the specified operations and/or functions. It will be understood that one or more blocks of the flowcharts, and combinations of blocks in the flowcharts, can be implemented by special purpose hardware-based computer systems which perform the specified operations and/or functions, or combinations of special purpose hardware with computer instructions.

While this specification contains many specific embodiments and implementation details, these should not be construed as limitations on the scope of any disclosures or of what may be claimed, but rather as descriptions of features specific to particular embodiments of particular disclosures. Certain features that are described herein in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

While operations and/or functions are illustrated in the drawings in a particular order, this should not be understood as requiring that such operations and/or functions be performed in the particular order shown or in sequential order, or that all illustrated operations be performed, to achieve desirable results. In certain circumstances, operations and/or functions in alternative ordering may be advantageous. In some cases, the actions recited in the claims may be performed in a different order and still achieve desirable results. Thus, while particular embodiments of the subject matter have been described, other embodiments are within the scope of the following claims.

While this specification contains many specific embodiment and implementation details, these should not be construed as limitations on the scope of any disclosures or of what may be claimed, but rather as descriptions of features specific to particular embodiments of particular disclosures. Certain features that are described herein in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are illustrated in the drawings in a particular order, this should not be understood as requiring that such operations be performed in the particular order shown or in sequential order, or that all illustrated operations be performed, to achieve desirable results. In certain circumstances, operations in alternative ordering may be advantageous. In some cases, the actions recited in the claims may be performed in a different order and still achieve desirable results.

The invention claimed is:

1. A method for segregation of flaring comprising:

receiving sensor data from at least a first sensor, wherein the sensor data is associated with a flare;

determining, based on the sensor data, a first gas volume of a first gas associated with the flare, wherein the flare is associated with a plurality of gases;

determining, via a machine learning process, one or more classifications of the flare based on the sensor data and the first gas volume, wherein the one or more classifications is chosen from a set of classifications including routine flaring, and wherein at least one of the one or more classifications of the flare is determined to be routine flaring.

2. The method of claim 1, wherein the set of classifications further includes non-routine flaring and safety flaring.

3. The method of claim 1, wherein the first sensor is a camera.

4. The method of claim 3, wherein the camera is configured to capture images in a visible light spectrum and an infrared light spectrum.

5. The method of claim 1, wherein the machine learning process is based on a flare profile of the flare over time.

6. The method of claim 1, wherein the machine learning process is based on a volume change of the flare over time.

7. The method of claim 1 further comprising:

training, prior to the determining one or more classifications of the flare based on the sensor data and the first gas volume, the machine learning process based on historical sensor data associated with one or more classifications of historical flares.

8. The method of claim 1 further comprising:

determining a second gas volume, wherein the second gas volume is associated with a gas that is distinct from a first gas associated with the first gas volume.

9. The method of claim 1 further comprising:

generating a user alert based on a classification.

10. The method of claim 1 further comprising:

generating, for a user interface, one or more dashboards for display on the user interface, wherein a first dashboard is configured to display a visualization of the first gas volume and at least one classification of the first gas volume.

11. An apparatus comprising at least one processor and at least one memory coupled to the processor, wherein the processor is configured to:

receive sensor data from at least a first sensor, wherein the sensor data is associated with a flare;

determine, based on the sensor data, a first gas volume of a first gas associated with the flare, wherein the flare is associated with a plurality of gases;

determine, via a machine learning process, one or more classifications of the flare based on the sensor data and the first gas volume, wherein the one or more classifications is chosen from a set of classifications including routine flaring, and wherein at least one of the one or more classifications of the flare is determined to be routine flaring.

12. The apparatus of claim 11, wherein the set of classifications further includes non-routine flaring and safety flaring.

13. The apparatus of claim 11, wherein the first sensor is a camera.

14. The apparatus of claim 13, wherein the camera is configured to capture images in a visible light spectrum and an infrared light spectrum.

15. The apparatus of claim 11, wherein the machine learning process is based on a flare profile of the flare over time.

16. The apparatus of claim 11, wherein the machine learning process is based on a volume change of the flare over time.

17. The apparatus of claim 11, wherein the processor is further configured to:

train, prior to the determining one or more classifications of the flare based on the sensor data and the first gas volume, the machine learning process based on historical sensor data associated with one or more classifications of historical flares.

18. The apparatus of claim 11, wherein the processor is further configured to:

determine a second gas volume, wherein the second gas volume is associated with a gas that is distinct from a first gas associated with the first gas volume.

19. The apparatus of claim 11, wherein the processor is further configured to:

generate a user alert based on a classification.

20. The apparatus of claim 11, wherein the processor is further configured to:

generate, for a user interface, one or more dashboards for display on the user interface, wherein a first dashboard is configured to display a visualization of the first gas volume and at least one classification of the first gas volume.

* * * * *